US005128686A

United States Patent [19]

Tan et al.

[11] Patent Number: 5,128,686

[45] Date of Patent: Jul. 7, 1992

[54] REACTANCE BUFFERED LOOP ANTENNA AND METHOD FOR MAKING THE SAME

[75] Inventors: William Tan, Lantana; Robert Kurcbart, Boca Raton, both of Fla.

[73] Assignee: Motorola, Inc., Schaumburg, Ill.

[21] Appl. No.: 572,306

[22] Filed: Aug. 27, 1990

Related U.S. Application Data

[63] Continuation of Ser. No. 299,276, Jan. 23, 1989, abandoned.

[51] Int. Cl.[5] ..... H01Q 7/00

[52] U.S. Cl. ..... 343/718; 343/744; 343/868; 333/24 R

[58] Field of Search ..... 343/718, 741, 743, 744, 343/868, 866, 870, 871, 702; 333/17.3, 32, 24 R, 24 C; 455/274, 290, 292, 344, 349, 351, 193

[56] References Cited

U.S. PATENT DOCUMENTS

| | | | |
|---|---|---|---|
| 4,201,960 | 5/1980 | Skutta et al. | 333/17.3 |
| 4,518,965 | 5/1985 | Hidaka | 343/742 |
| 4,713,808 | 12/1987 | Gaskill et al. | 370/94 |
| 4,922,260 | 5/1990 | Gaskill et al. | 343/718 |

FOREIGN PATENT DOCUMENTS

| | | | |
|---|---|---|---|
| 196602 | 12/1982 | Japan | 343/743 |
| 212015 | 10/1985 | Japan | 333/32 |

*Primary Examiner*—Michael C. Wimer

*Attorney, Agent, or Firm*—Philip P. Macnak; Vincent B. Ingrassia; William E. Koch

[57] ABSTRACT

A reactance buffer maintains a substantially constant reasonant frequency for an adjustable size loop antenna having first and second antenna segments. Each segment has first and second ends, the first ends being coupled to a receiver, and the second ends providing loop size adjustment. The reactance buffer comprises a reactance buffer input coupled to the second end of the first antenna segment. A plurality of taps are linearly disposed along a longitudinal axis of the first wristband section, and has a predetermined length between the outermost taps corresponding to the loop antenna size adjustment required. The taps provide selectable reactance buffer outputs for coupling to the second end of the second antenna segment. A plurality of reactance elements are arranged non-serially and couple the reactance buffer input to each of the plurality of taps and provide a substantially constant reactance measured between the reactance buffer input and each of the plurality of taps.

37 Claims, 5 Drawing Sheets

— PRIOR ART —

— PRIOR ART —

— PRIOR ART —

REACTANCE BUFFERED LOOP ANTENNA AND METHOD FOR MAKING THE SAME

This is a continuation of application Ser. No. 07/299,276, filed Jan. 23, 1989, now abandoned.

FIELD OF THE INVENTION

This invention relates generally to the field of loop antennas, and more particularly to a reactance buffered loop antenna suitable for use as a wristband antenna for a wrist worn electronic device.

DESCRIPTION OF THE PRIOR ART

As electronic circuits have been miniaturized, and in particular receivers, it has become possible to package the electronics into housings suitable to be comfortably worn on the wrist. Antennas used with these wristworn receivers have often utilized simple single turn loop antennas which have been incorporated into the wristband of the device. Such an antenna generally used a nonstretchable two-piece wristband is shown in FIG. 1. Rivets, or similar fasteners, were used to provide a series of regularly spaced holes in one of the wristband sections required to accommodate the varying sizes of the human wrist, often providing the electrical connection to close the loop when the wristband was fastened to the wrist. Since the inductance of such a loop antenna is dependent upon the physical geometry of the loop antenna, such as loop diameter or length, the tuning of such a loop antenna varied with the wrist size. Consequently, when the loop antenna was tuned for a particular wrist size, increasing or decreasing the loop diameter by increasing or decreasing the loop length, as would happen when an adjacent contact point was selected when strapping the device to the wrist, resulted in substantial changes in the antenna's resonant frequency and correspondingly substantial changes in the receiver's sensitivity. As a consequence, factory pretuning of such a wristband loop antenna was not possible. Commercialization of such wrist worn receivers was consequently limited to retailers employing skilled technicians capable of tuning the antennas on the devices as they were sold. As noted, even this did not guarantee antenna performance when the wearer was inconsistent in strapping the device to the wrist.

Other antenna structures have also been proposed for use in wristworn receivers. One such wristband antenna consisted of a number of ferrite antenna links affixed to a rigid wristband. Another wristband antenna consisted of conductors incorporated into a wristband so as to allow a stretchable wristband. Both types of antennas exhibited the same tuning problems as the non-stretchable wristband antenna. As the geometry of the loop was changed, and depending upon the position on the wrist, detuning and reduced receiver sensitivity would occur.

SUMMARY OF THE INVENTION

A reactance buffer is described for maintaining a substantially constant resonant frequency for an adjustable size loop antenna having a plurality of selectable loop circumferences, the loop antenna formed from first and second conductor antenna segments, each antenna segment having first and second ends, the first ends of each antenna segment being coupled to a receiver input, the second ends of each antenna segment being selectably coupled providing adjustment of the loop circumference. The reactance buffer comprises a buffer input coupling to the second end of the first antenna segment. A plurality of taps are linearly disposed along a longitudinal axis of the reactance buffer, the distance between the outermost of said plurality of taps providing a predetermined length corresponding to the length of adjustment of the loop circumference. The taps provide selectable coupling positions for coupling to the second end of the second antenna segment. A plurality of reactance elements arranged non-serially between the reactance buffer input and each of the plurality of taps when one or more of the reactance elements are coupled between the input and a corresponding one of the taps to provide a substantially constant reactance when measured between the reactance buffer input and each of the plurality of taps.

A wristband loop antenna is described for a wristworn electronic device which includes a receiver having signal and ground inputs coupled to an antenna resonating capacitor for resonating the loop antenna to a predetermined frequency. The wristband loop antenna comprises first and second wristband sections. The first wristband section includes a first conductor having a first end coupled to the receiver signal input and a second end. The first conductor forms a first portion of the loop antenna within the first wristband section. A reactance buffer is coupled to the second end of the first conductor, the input buffer having a plurality of taps linearly disposed along a longitudinal axis of the reactance buffer. The distance between the outermost taps provides a predetermined length corresponding to the loop antenna diameter adjustment. A plurality of reactance elements is arranged non-serially between the reactance buffer input and each of the plurality of taps, wherein one or more of the reactance elements are coupled between the input and a corresponding one of the taps to provide a substantially constant reactance when measured between the reactance buffer input and each of the plurality of taps. A second wristband section includes a second conductor having a first end coupled to the receiver ground and a second end. The second conductor forms a second portion of the loop antenna within the second wristband section. A coupling device couples to the second end of the second conductor for coupling the conductor to one of the plurality of taps. When the wristband length is adjusted by selecting one of the plurality of taps, the resonant frequency of the wristband loop antenna remains substantially unchanged.

It is an object of the present invention to provide a loop antenna having an adjustable size which does not require tuning when the size is changed.

It is a further object of the present invention to provide a loop antenna which is adapted for use with a wristworn device.

It is a further object of the present invention to provide a wristband loop antenna which can be pretuned.

It is a further object of the present invention to provide a wristband loop antenna which when tuned is insensitive to changes in the wristband length.

BRIEF DESCRIPTION OF THE DRAWINGS

The features of the invention which are believed to be novel are set forth in particularity in the appended claims. The invention itself, together with its further objects and advantages thereof, may be best understood by reference to the following description when taken in conjunction with the accompanying drawings, in which the several figures of which like reference numerals identify identical elements, in which:

Table I compares the performance of a loop antenna utilizing an inductive reactance buffer to the performance of a prior art loop antenna.

Table II illustrates the performance of a loop antenna utilizing a capacitive reactance buffer.

DESCRIPTION OF THE PREFERRED EMBODIMENT

Figure 1:
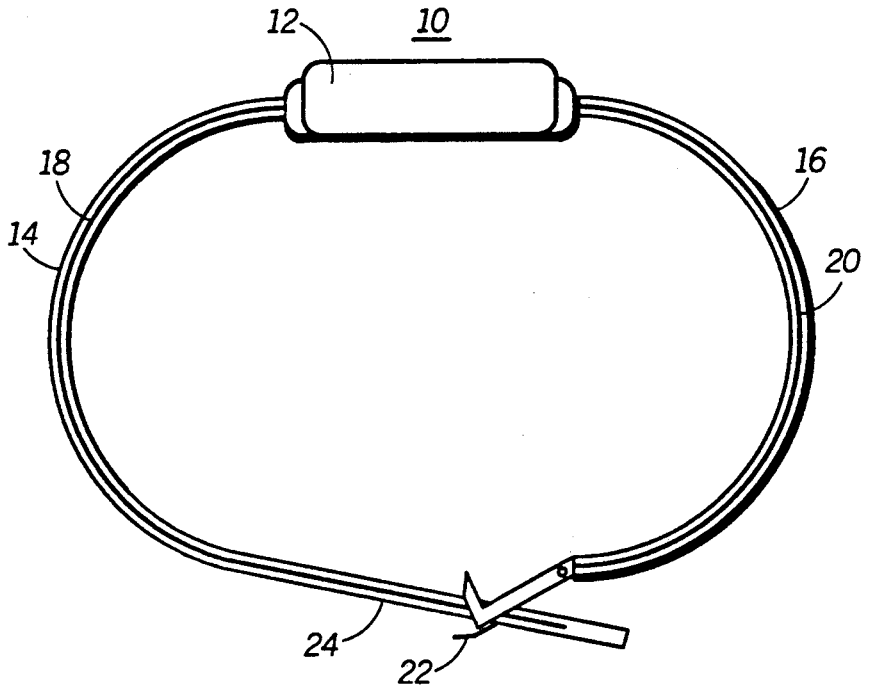
FIG. 1 is a diagram of a prior art wristworn device utilizing a wristband loop antenna.

With respect to the figures, FIGS. 3 to 6 illustrate the preferred embodiment of the present invention, a buffered loop antenna suitable for use with a wristworn electronic device. In order to appreciate the advantages of the present invention, it is best to describe in some detail the operation of at least one prior art wristband loop antenna in order to provide an understanding of some of the problems previously encountered. A typical prior art wristband loop antenna arrangement 10 is shown in FIG. 1. The receiver is located in housing 12 to which two non-stretchable straps 14 and 16 are attached. Within each strap 14 and 16 is located a conductor 18 and 20 respectively. This conductor may be either a round or a flat conductive wire. Attached to one of the wristband straps 14, a conventional buckle 22 is provided which connects to one end of conductor 18. In the other wristband strap 16, a series of regularly spaced holes 24 (not shown) are provided to allow for adjustment of the wristband length. An eyelet is often inserted into each of the holes to provide electrical connection with conductor 20 within strap 16. This is shown in greater detail in FIG. 2A.

Figure 2A:
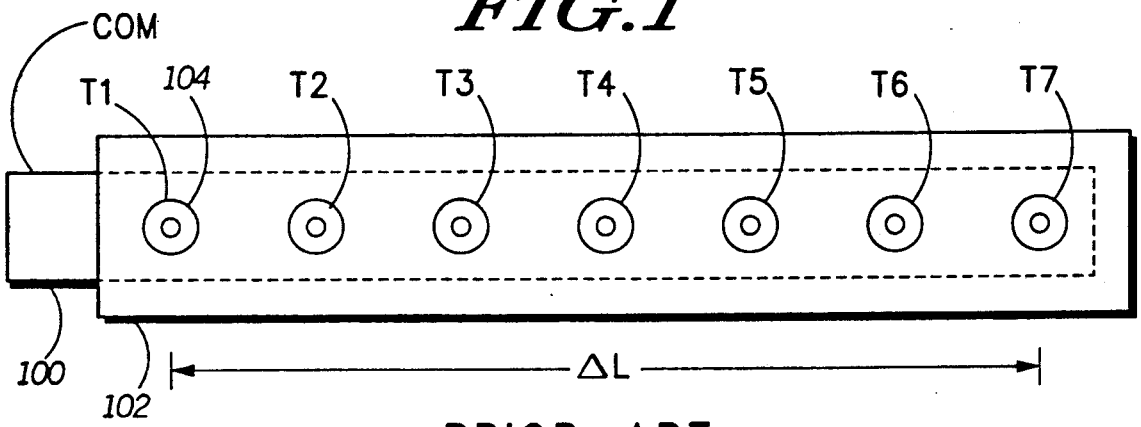
FIG. 2A is an exploded view of one half of the adjustable strap section of FIG. 1.
Figure 2B:
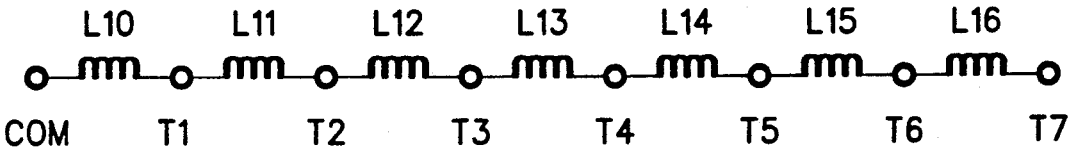
FIG. 2B is an electrical schematic diagram of FIG. 2A.

As shown in FIG. 2A, a wide flat sheet-metal conductor 100 is located within strap 102. Eyelets 104 provide contact to conductor 100. The holes used to provide adjustment of the wristband are marked T1 through T7 and are evenly spaced over a length of the wristband, designated $\Delta L$. For a typical wristband, $\Delta L$ is approximately 44 millimeters in length for typical variations in adult wrist size. A loop antenna constructed as shown in FIGS. 1 and 2A is an electrically small loop antenna, approximately one-quarter wavelength in size at VHF frequencies. Such a loop antenna is inductive at most frequencies of interest, and is capacitively tuned. Consequently, the adjustable portion of the wristband may be represented as a series of inductive elements, as shown in FIG. 2B. The particular magnitude of the inductance of each element is a function of the geometry, or size, of the conductor, in this instance, the conductor geometry between each tap T1 through T7. It will be appreciated, when the clasp is connected to tap T1, the wristband size, which is also the relative loop antenna size or diameter is a minimum. When the clasp is connected to tap T7, the wristband size, or relative loop antenna size or diameter is a maximum. Thus, it will be appreciated, when the loop antenna is adjusted and tuned for length T1, the tuning will be substantially changed at length T7, and for intermediate lengths as well, resulting in reduced receiver sensitivity at lengths other than where originally tuned.

Figure 3A:
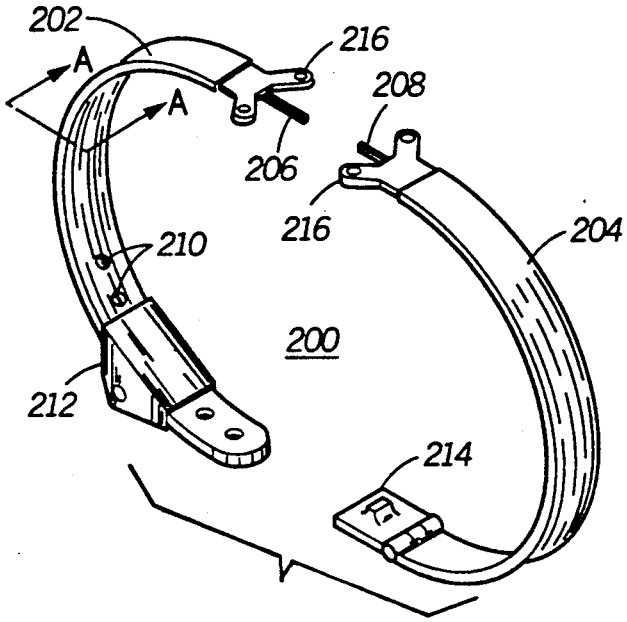
FIG. 3A is a diagram of a wristband loop antenna for the preferred embodiment of the present invention.

FIGS. 3A, 3B, 3C and 3D show the general construction of a wristband loop antenna for the preferred embodiment of the present invention. As shown in FIG. 3A, the wristband loop antenna 200 includes two non-stretchable, but flexible straps, or wristband sections 202 and 204. The first wristband section 202 includes a first conductor 206 which forms a first portion of the loop antenna, while the second wristband section 204 includes a second conductor 208 and forms the second portion of the loop antenna. The first wristband section 202 further includes a series of regularly spaced apertures 210, such as holes or slots, linearly disposed along the wristband to provide adjustability.

A standard two piece clasp, used widely in the watch industry is utilized in the construction of the preferred embodiment of the present invention. The clasp is suitably modified, such as with plating, to minimize corrosion problems and to maintain low ohmic electrical contact when the clasp is secured. Platings, such as selective gold plating of the contact surfaces is preferred, although other plating techniques may be employed equally as well. Adjustable clasp 212 is slidably positioned along wristband section 202, and provides electrical contact to first conductor 206. Attached to the end of the second wristband section 204 is a fixed clasp 214, which couples to one end of second conductor 208, and together with adjustable clasp 212 provides the means to both electrically complete the loop antenna, and to mechanically secure the wristband 200 to the wrist. First wristband section 202 and second wristband section 204 are affixed to the wristworn device by an attachment means, such as rigid mounting brackets 216, which are secured to the device housing by fasteners, such as screws (not shown). Mounting brackets 216 may be formed from sheet metal, such as stainless steel, or other suitable material which is generally unaffected by contact with the skin. Stainless steel is advantageous in not requiring any plating for providing corrosion resistance. It will be appreciated, the rigid mounting of the wristband sections is exemplary and that other attachment means, such as the use of watch style spring loaded pins, may be used as well.

In the preferred embodiment of the present invention, conductor 208 is a flat sheet-metal conductor formed from half hard beryllium copper material which is 3–4 mils thick. Other materials such as copper, nickel silver, and other conductive materials may be used as well. Conductor 208 is generally continuous through the length of wristband section 204, coupling on one end to the fixed clasp 214 and to a receiver input, such as the receiver ground input, at the device housing. Conductor 208 may be formed in a manner shown in FIG. 3C to provide positive retention of the conductor within the body of wristband section 204.

Figure 3B:
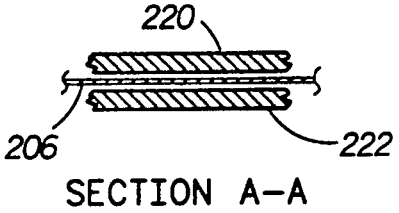
FIG. 3B is a diagram showing a cross section of the wristband strap showing the construction of the strap for the preferred embodiment of the present invention.
Figure 3C:
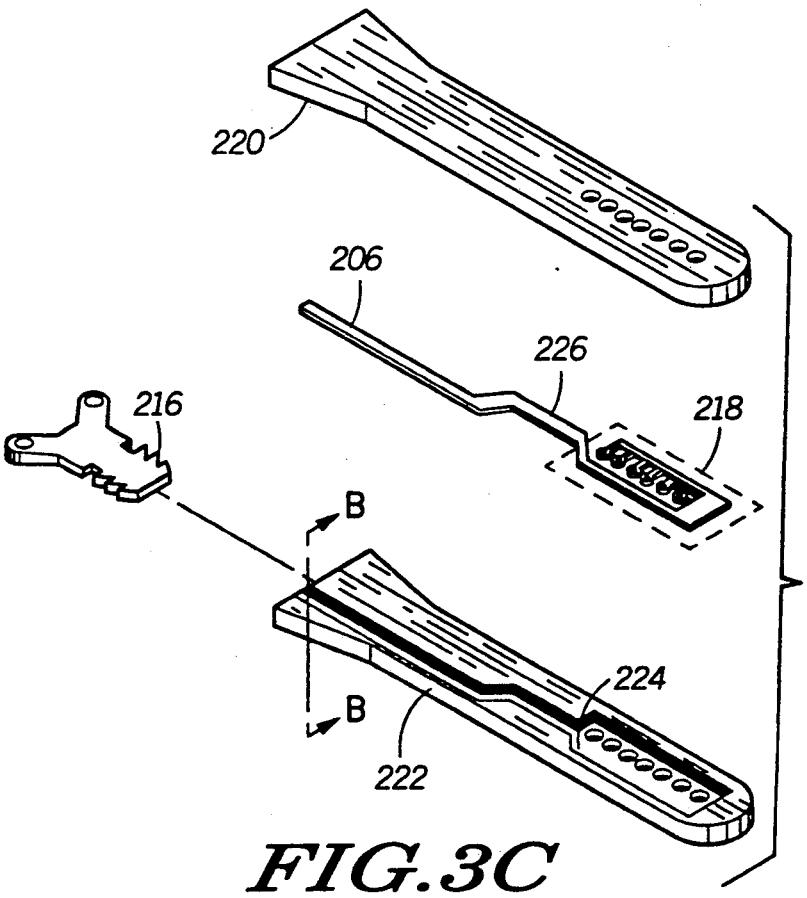
FIG. 3C is a diagram of the construction of an inductive reactance buffer for the preferred embodiment of the present invention.
Figure 3D:
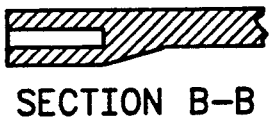
FIG. 3D is a diagram showing a second cross section of the wristband strap showing the construction of the strap for the preferred embodiment of the present invention.

FIG. 3B and 3C shows the construction details for the first wristband section 202. In the preferred embodiment of the present invention, wristband section 202 is constructed by laminating conductor 206 and reactance buffer 218, which will be described in detail shortly, between top 220 and bottom 222 members which are non-stretchable, flexible materials formed by any number of suitable methods, such as by injection molding or die cutting, as shown in FIG. 3B. Any number of materials may be used for the top 220 and bottom 222 members, such as a urethane rubber, leather and the like. The bottom member 222, or the top member 220, may include a recessed area, such as recess 224, in which conductor 206, reactance buffer 218, and mounting bracket 216 are positioned. Such a recessed area can be formed in the material when the strap is molded. As shown in FIG. 3C, conductor 206 has an bent conductor portion 226 which is used to retain the conductor in the recess and prevents the conductor from pulling out or moving in the finished wristband section When it is impractical to provide a recess, adhesives may be utilized to provide the retention of the conductor. Depending on the material of the two members, the two members may be joined by such processes as chemical bonding, including solvents and adhesives; mechanical bonding, including thermal, and ultrasonic bonding; and stitching or adhesive bonding, as in the case of a leather wristband. Insert molding of complete wristband sections may also be used, thereby eliminating many of the secondary wristband assembly operations described. Conductors 206 and 208 are formed from flat sheet metal using such methods as stamping, chemical etching, or other suitable process. Mounting bracket 216 is retained within a cavity formed within a portion of the wristband section, as shown in the cross-sectional diagram of FIG. 3D. Mounting bracket 216 is retained within the cavity by any of a number of well known methods, such as with the use of serrated edges formed as part of the bracket, as illustrated.

Figure 4:
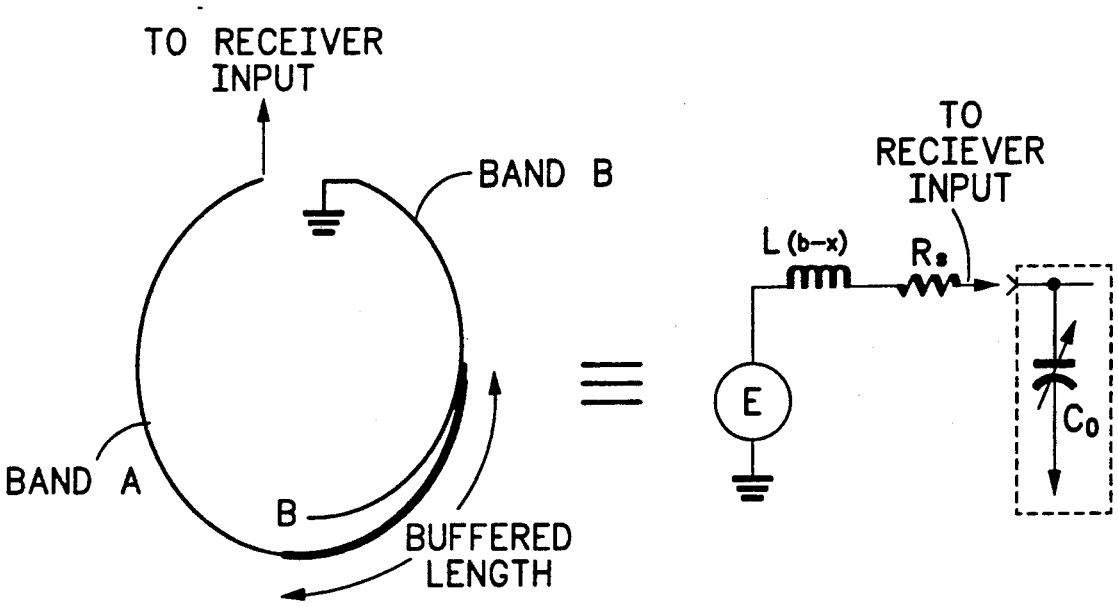
FIG. 4 is an diagram of a typical wristband loop antenna and an equivalent electrical schematic diagram.

FIG. 4 shows a diagram of a wristband antenna and an equivalent electrical schematic diagram which is useful in describing the operation of both the prior art wristband loop antenna, and the buffered loop antenna of the present invention. As previously described, the wristband loop antenna formed by bands A and B are inductive at the operating frequency, indicated schematically as $L_{(b-x)}$, the subscript denoting the plurality of inductances as the length of the loop is adjusted (x indicating position $T_1$ to $T_7$ and b indicating the reference end of the second band as shown in FIG. 4). The resistance associated with the conductors is shown schematically as $R_s$. The wristband loop antenna couples to a receiver input and ground as shown, and is capacitively tuned, the capacitor shown schematically as $C_o$. In the preferred embodiment of the present invention, capacitor $C_o$ couples between the receiver input and ground. The voltage delivered from the loop antenna operating in an electromagnetic field is shown schematically as the voltage source labeled E.

The operating frequency of the antenna may be determined by the following well known equation.

$$F_{ant} = 1 / 2\pi\sqrt{L_{(b-x)}C_o}$$

From the previous description of FIGS. 2A and 2B, it was noted the inductance at tap T1, does not equal the inductance at the other taps. Thus $$L_{(b-1)} \neq L_{(b-2)} \neq \ldots \neq L_{(b-7)}$$

where $L_{(b-1)}$, etc. represents the magnitude of the total inductance measure at each tap position. The total inductance of the loop antenna is the sum of the inductance of band A and band B, corrected for the differential inductance associated with varying the length of the loop in the adjustable zone.

It then follows, if $C_o$ is kept constant, such as when the capacitor is pretuned at one of the wristband lengths, then $$F_{ant(b-1)} \neq F_{ant(b-2)} \neq \ldots \neq F_{ant(b-7)}$$

which demonstrates, as previously stated, the prior art wristband loop antenna requires retuning to eliminate variations in adjusting the wristband to different wrist sizes. This problem is substantially minimized with the reactance buffer described in FIG. 3B, the operation of which will be described in detail with FIGS. 5A and 5B. In practice, the reactance buffer of the present invention provides substantially a constant reactance for each tap position along the wristband, such that $$L_{(b-1)} = L_{(b-2)} = \ldots = L_{(b-7)}$$

which results in $$F_{ant(b-1)} = F_{ant(b=2)} = \ldots = F_{ant(b-7)}$$

The reactance buffer for the preferred embodiment of the present invention, by providing a substantially constant reactance at each tap position, allows the wristband loop antenna to be tuned only once at any of the selectable wristband lengths, and thereafter the wristband loop antenna remains tuned, even when the diameter of the antenna loop is changed.

Figure 5A:
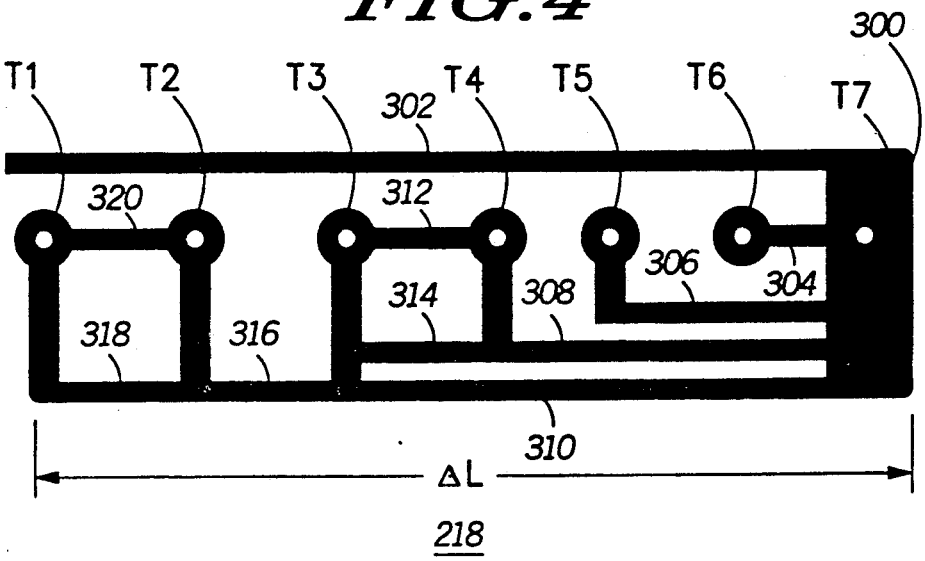
FIG. 5A is a diagram of the inductive reactance buffer for the preferred embodiment of the present invention.
Figure 5B:
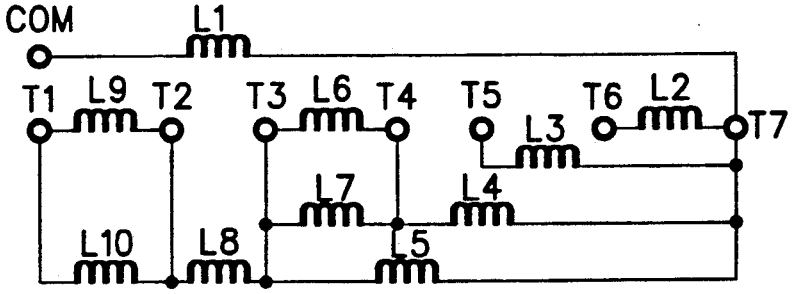
FIG. 5B is an electrical schematic diagram of the inductive reactance buffer of FIG. 5A.

FIG. 5A shows a diagram of the physical layout of the reactance buffer 218 for the preferred embodiment of the present invention. An approximate schematic diagram of reactance buffer 218 is shown in FIG. 5B. It will be appreciated, that the schematic diagram of FIG. 5B is only a first order approximation for the reactance buffer, in that each conductor in the circuit has an associated inductance value. The schematic diagram of FIG. 5B represents inductance values associated with horizontal conductors. While the vertical conductors also have inductance values associated with them, they are shown schematically as conductors, or conductive elements. It will be appreciated, this first order approximation is sufficient to one of ordinary skill in the art to understand the operation of the reactance buffer 218 to be described.

Reactance buffer 218 is an integrated structure, as shown in FIG. 5A in that the buffer input, the taps, and the reactance elements are formed from a flat sheet metal strip. The taps are linearly disposed along the integrated structure providing buffer outputs to select the wristband size. The outermost taps, T1 and T7, are spaced a predetermined length, corresponding to the amount of wristband size adjustment required.

Referring to FIG. 5B, first conductor 206 is shown schematically as inductor L1. Reactance buffer 218 input is shown generally as conductor 300. Reactance buffer 218 includes a plurality of taps T1–T7 which are used to adjust the length of the wristband, or conversely, the diameter of the wristband loop antenna. It will be appreciated, the number of taps provided for the adjustment range is for example only, and other numbers may be provided when necessary. Reactance buffer 218 comprises a plurality of reactance elements, shown schematically as inductive elements, or inductors, L2–L10. The arrangement, i.e. series/parallel combinations of these reactance elements, results in a substantially constant reactance when measured between the buffer input 300 and each of the taps T1–T7. As shown, each inductive element is in actuality a conductor, the value of the inductance being a function of the geometry of the inductor. Thus, L2 which corresponds to conductor 304, has a substantially equivalent inductance value to L3 which corresponds to conductor 306. Inductance values at other taps are combinations of inductances corresponding to a number of series and parallel inductors, as shown.

Table I illustrates the relative performance of the inductive reactance buffer compared to the prior art loop antenna design. All measurements are referenced to tap T1, and includes a conductor length equivalent to that found in the first antenna portion. The relative length is the additional length of the wristband, as the wristband is adjusted from T1 to T7. The inductance change is the change in inductance value associated with each tap relative to the inductance reference measure at T1. The total inductance and change in inductance for the prior art antenna are tabulated in the last two columns of Table I. As Table I shows, the change in inductance for the prior art antenna was measure at 59.1 nanohenries, compared to a maximum change of 4.3 nanohenries. It will be appreciated that further optimization of the conductor geometries in the reactance buffer can be made to reduce this difference.

As shown in FIGS. 3B and 5A, reactance buffer 218 may be advantageously and economically formed from a single flat sheet metal conductor which has been formed, such as by die stamping or chemical etching. It will be appreciated, the conductor pattern shown is, for example, only, and any number of conductor patterns may be generated which achieve the same result, a substantially constant reactance measured between the buffer input and each output tap. The conductive pattern may be formed from sheet metal, such as copper, beryllium copper and nickel silver. The material is selected to provide the required flexibility, and to withstand the repeated flexing associated with wearing the wristband and repeatedly putting on and removing the wristband from the wrist. The conductor may be plated to enhance the solderability, and durability of the conductor, with a plating such as a copper, nickel, tin plating.

Other materials for forming the reactance buffer may also be employed, other than described above. One such material may be a copper foil laminated KAPTON material, wherein the reactance buffer pattern is formed using convention printed circuit etching techniques. Coupling of the pattern to the tap areas would be the same, or similar to the stamped metal reactance buffer, such as with rivets.

Figure 6A:
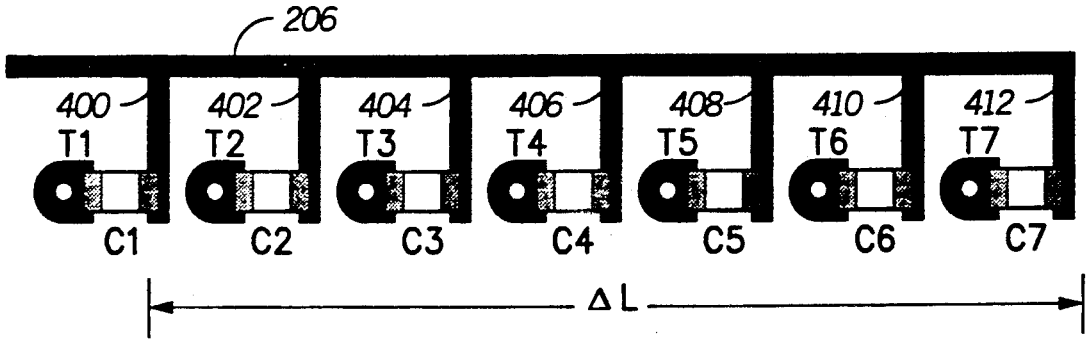
FIG. 6A is a diagram of a capacitive reactance buffer for an alternate embodiment of the present invention.
Figure 6B:
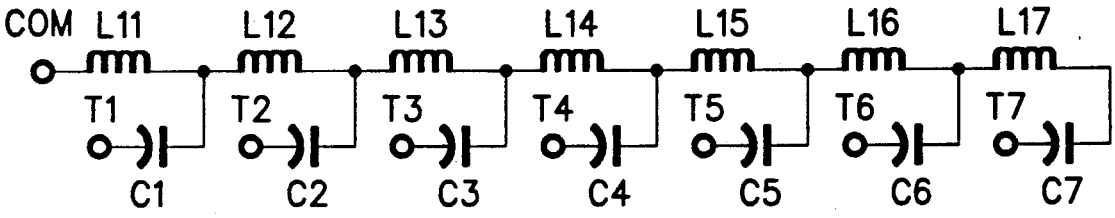
FIG. 6B is an electrical schematic diagram of the capacitive reactance buffer of FIG. 6A.

Alternate construction methods for the reactance buffer is shown in FIGS. 6A/6B and 7A–7C. The reactance buffers of FIGS. 6A/6B and 7A–7C utilize a plurality of fixed value capacitors to achieve a substantially constant reactance when the length of the wristband is adjusted. As shown in FIG. 6A, a portion of conductor 206 is tapped using conductors 400–412, somewhat in the method of the prior art. However, unlike the prior conductor 206 is coupled to each output tap T1–T7 through a fixed capacitor C1–C7. FIG. 6B shown an approximate schematic diagram of FIG. 6A. In the instance where both inductive and capacitive elements are utilized in the reactance buffer, the reactance elements may be considered to include a plurality of paired inductive and capacitive elements, such as L11 and C1. Each inductive and capacitive element has an input and an output, the input of the capacitive element being coupled to the output of the inductive element, and the output of the capacitive element being coupled to a tap. The inductive elements are then coupled in series, resulting in the structure shown in FIG. 6B. The values for C1–C7 are selected to provide a substantially constant reactance between the input and each output tap, the magnitude of this capacitance being computed as follows:

$$2\pi f L_{cum} + \tfrac{1}{2}\pi f C_{tap} = a\ constant$$

where f is the frequency of operation, $L_{cum}$ is the cumulative inductance associated with each tap, and $C_{tap}$ is the particular tap capacitance. Thus, $L_{cum}$ would equal L11 L12, and $C_{tap}$ would be C2 for tap T2. Thus, C1, when used, would have the smallest capacitance value for resonating with inductor L11, whereas C7 would have the largest capacitance value for resonating with the series combination of L11–L17. While capacitor C1 is shown, it will be appreciated C1 can be omitted with the buffer retaining the same electrical characteristics previously described, in which case C2 would have the smallest inductance value resonating with $L_{11}$ and $L_{12}$.

Figure 7A:
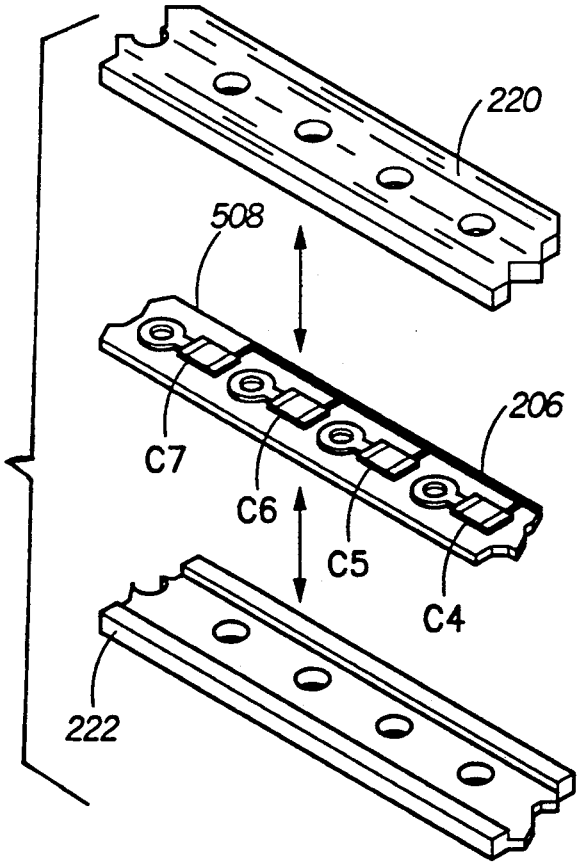
FIG. 7A is a diagram of the construction of the capacitive reactance buffer of the alternate embodiment of the present invention.

One construction method for a reactance buffer utilizing capacitive and inductive elements is shown in FIG. 7A. A flexible circuit 508, such as a KAPTON film with laminated copper foil is first etched to provide a pattern similar to shown in FIG. 6A. Capacitors C4–C7, such as leadless, surface mountable chip capacitors, having appropriate values are then soldered, such as using reflow soldering, to attach the capacitors to the conductors. A molded, or die cut, elastomer or leather band is then assembled enclosing the flexible circuit using one of more of the procedures previously described for the inductive reactance buffer of FIGS. 3A and 3B.

Table II illustrates the relative performance of the capacitive/inductive reactance buffer. All measurements are referenced to tap T1, and includes a conductor length equivalent to that found in the first antenna portion. The relative length is the additional length of the wristband, as the wristband is adjusted from T1 to T7. The total inductance is listed for three tap positions. Cadded is the computed capacitance required to resonate the total inductance at each tap to a predetermined operating frequency, which in the case of this example is 157.7 MHz. As table II shows, proper selection of fixed value capacitors at each tap can substantially eliminate any changes in antenna tuning, as the length of the wristband is changed.

Figure 7B:
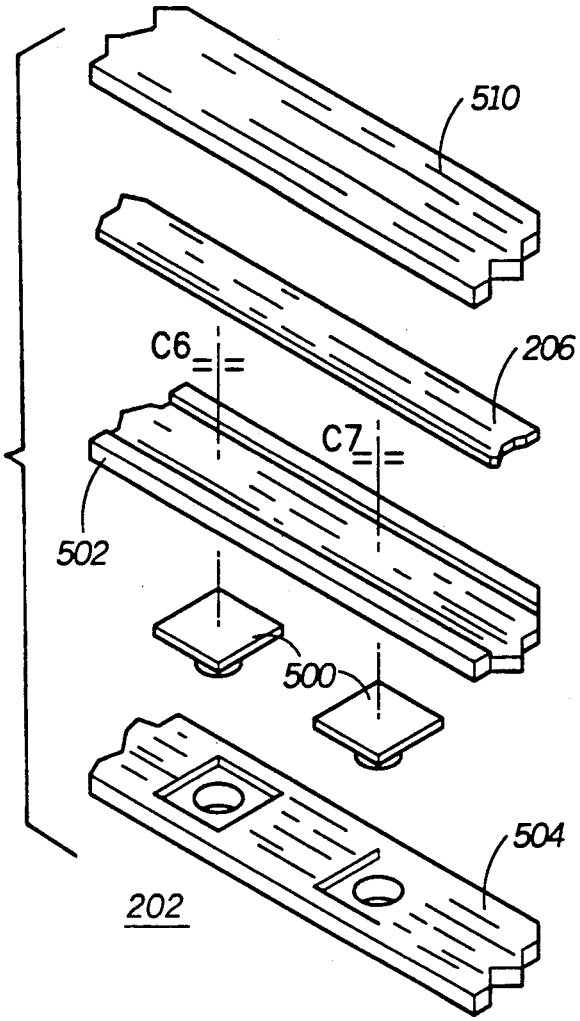
FIG. 7B and 7C are diagrams showing an alternate construction embodiment of the capacitive reactance buffer.
Figure 7C:
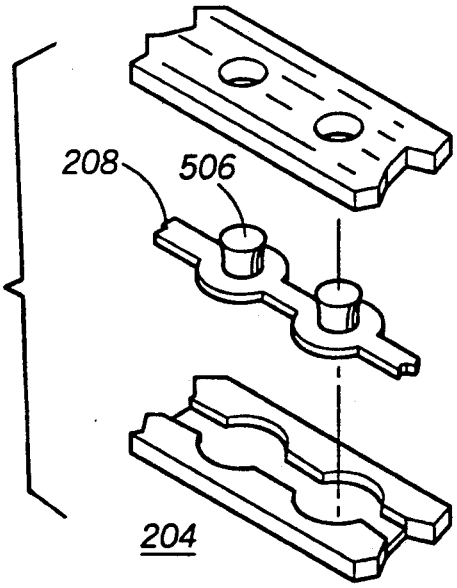

An alternate construction for the capacitive reactance buffer is shown in FIGS. 7B and 7C. In this instance, the capacitors are formed during the construction of the wristband section 202. As shown in FIG. 7B, one plate of capacitors C1–C7 is coupled with a contact 500. The size of the plate 500 is a function of the capacitance required at each tap, the thickness of dielectric layer 502, and the dielectric constant of dielectric layer 502. Computation of the size of the capacitor plate is well known to one of ordinary skill in the art. The second plate of each of the capacitors C1–C7 is provided by conductor 206. In practice, capacitor plate/contacts 500 are placed in a molded wristband half 504. Each capacitor plate/contact has a different geometry corresponding to the required capacitance at each tap. Dielectric layer 502 is positioned over the contacts, followed by the positioning of conductor 206. Dielectric layer 502 may be molded from a suitable dielectric, having a recess in which to position conductor 206. Finally, the top wristband half 510 is positioned on the stack, and the combination laminated by one or more appropriate techniques previously described for the inductive reactance buffer construction.

As shown in FIG. 7C, wristband section 204 may be constructed to provide connection to the capacitor/inductor buffer. In this instance, conductor 208 may be formed, such as by stamping or coining techniques, to form contacts 506 to be plugged into capacitor plate/contacts 500. Two contacts are shown in this alternate embodiment of the present invention. The two contact arrangement provides additional strength to the clasp when the clasp is secured as well as a more reliable electrical contact. Other methods of forming the contact on conductor 502 may also be employed, such as by attaching separate fixed contacts.

As in the case of the inductive buffer of FIG. 5A, the capacitive buffers of FIGS. 7A–7C may be described as a flat integrated structure which includes the buffer input, taps and reactance elements.

While the description of the buffered loop antenna has been directed primarily for use in a wristband, it will be appreciated, the reactance buffer of the present invention can be used in other loop antenna applications as well. Examples of such applications, include any variable size loop antenna, either electrically small or electrically large and having any cross sectional configuration, such as circular, square, rectangular or other. Other applications include such special purpose variable size loop antennas, such as could be located in belts, rigid bracelets, ankle straps, and the like.

While specific embodiments of the present invention have been shown and described, further modifications and improvements will occur to those skilled in the art. All modifications which retain the basic underlying principles disclosed and claimed herein are within the scope and spirit of the present invention.

TABLE I

| | Buffered Band Antenna | | | Band Antenna | |
|---|---|---|---|---|---|
| Band's Position B (x) | Relative Length $\Delta l = B(x) - B(1)$ | Inductance L(nH) | Relative Inductance $\lvert\Delta L = L(B-1) - L(B-x)\rvert$ | Inductance L(nH) | Relative Inductance $\lvert\Delta L = L(B-1) - L(B-x)\rvert$ |
| B-1 | 0 mm | 193.7 | 0.0 nH | 142.4 nH | 0 nH |
| B-2 | 9.04 mm | 192.1 | 1.6 nH | — | — |
| B-3 | 16.05 mm | 192.6 | 1.1 nH | — | — |
| B-4 | 23.06 mm | 195.9 | 2.2 nH | 168.1 nH | 25.7 nH |
| B-5 | 30.07 mm | 192.4 | 1.3 nH | — | — |
| B-6 | 37.08 mm | 189.4 | 4.3 nH | — | — |
| B-7 | 44.09 mm | 196.4 | 2.7 nH | 201.5 nH | 59.1 nH |

nH = nanohenries

TABLE II

| Band's Position | Relative Length $\Delta L = B(x) - B(1)$ | Inductance $L(B-x)$ | $C_{added}$ | $F_{ant}$ |
|---|---|---|---|---|
| B-1 | 0 mm | 142.4 nH | 0 pF | 157.75 MHz |
| B-2 | 9.04 mm | — | — | — |
| B-3 | 16.65 mm | — | — | — |
| B-4 | 23.05 mm | 168.1 nH | 39.8 pF | 157.75 MHz |
| B-5 | 30.07 mm | — | — | — |
| B-6 | 37.08 mm | — | — | — |
| B-7 | 44.09 mm | 201.5 nH | 17.2 pF | 157.75 MHz |

nH = nanohenries

We claim:

1. A reactance buffer, for maintaining a substantially constant resonant frequency for a loop antenna having a plurality of selectable loop circumferences, the loop antenna formed from first and second conductor antenna segments, each antenna segment having first and second ends, the first ends of each antenna segment being coupled to a receiver input, the second ends of each antenna segment being selectably coupled for providing adjustment of the loop circumference, said buffer comprising:

a reactance buffer input coupled to the second end of the first antenna segment;

a plurality of taps, linearly disposed along a longitudinal axis of the reactance buffer, the distance between the outermost of said plurality of taps providing a predetermined length corresponding to the length of adjustment of the loop circumference, said taps providing selectable coupling positions for coupling to the second end of the second antenna segment; and a plurality of reactance elements, arranged non-serially between said reactance buffer input and each of said plurality of taps, wherein one or more of said reactance elements are coupled between said input and a corresponding one of said taps to provide a substantially constant reactance when measured between said reactance buffer input and each of said plurality of taps, whereby the resonant frequency of the loop antenna remains substantially constant when the loop circumference is adjusted.

2. The reactance buffer according to claim 1, wherein said reactance elements are inductive elements.

3. The reactance buffer according to claim 2, wherein the magnitude of the inductance measured between the buffer input and each tap is substantially constant.

4. The reactance buffer according to claim 2, wherein each of said inductive elements is formed from a conductor.

5. The reactance buffer according to claim 4, wherein said conductors are formed from sheet metal.

6. The reactance buffer according to claim 5, wherein said sheet metal is selected from a group of sheet metals consisting of copper, beryllium copper, and nickel silver.

7. The reactance buffer according to claim 1, wherein said reactance elements comprise a plurality of paired inductive and capacitive elements defining inductor/-capacitor pairs.

8. The reactance buffer according to claim 7, wherein said inductive elements are coupled in series with said buffer input.

9. The reactance buffer according to claim 7, wherein each of said inductive elements if formed from a conductor.

10. The reactance buffer according to claim 9, wherein said conductors are formed from sheet metal.

11. The reactance buffer according to claim 10, wherein said sheet metal is selected from a group of sheet metals consisting of copper, beryllium copper, and nickel silver.

12. The reactance buffer according to claim 7, wherein said capacitive elements are fixed value capacitors.

13. The reactance buffer according to claim 12, wherein each inductor of each inductor/capacitor pair has an input and an output terminal, each of said capacitors of each inductor/capacitor pair has an input and an output terminal, each capacitor input terminal being coupled to a respective inductor output terminal, and each capacitor output terminal being coupled to a respective one of said plurality of taps.

14. The reactance buffer according to claim 13, wherein the magnitude of $2\pi fL_{cum}+1/(2\pi fC_{tap})$ measured from said buffer input to each of said plurality of taps is substantially constant, f being the frequency of operation, $L_{cum}$ being the cumulative inductance associated with each of said plurality of taps, and $C_{tap}$ being the tap capacitance of each of said inductor/capacitor pairs coupled to each of said plurality of taps.

15. The reactance buffer according to claim 4, wherein the inductance of each inductive element is controlled by the conductor geometry.

16. The reactance buffer according to claim 9, wherein the inductance of each inductive element is controlled by the conductor geometry.

17. A buffered loop antenna, having a plurality of selectable loop circumferences, the loop antenna being coupled to a receiver having signal and ground inputs coupled to an antenna resonating capacitor for resonating the loop antenna to a predetermined frequency, said loop antenna comprising:

a first conductor, having a first end coupled to the receiver signal input and a second end, said first conductor forming a first portion of the loop antenna;

a second conductor, having a first end coupled to the receiver ground and a second end, said second conductor forming a second portion of the loop antenna;

reactance buffer means, comprising a reactance buffer input coupled to said second end of said first conductor, a plurality of taps linearly disposed along a longitudinal axis of said reactance buffer the distance between the outermost of said plurality of taps providing a predetermined length corresponding to the loop circumference adjustment, and a plurality of reactance elements, arranged non-serially between said reactance buffer input and each of said plurality of taps, wherein one or more of said reactance elements are coupled between said input and a corresponding one of said taps to provide a substantially constant reactance when measured between said reactance buffer input and each of said plurality of taps; and coupling means, coupled to said second end of said second conductor, for coupling said second conductor to any of said plurality of taps, whereby the resonant frequency of the loop antenna remains substantially constant when any of said plurality of taps is selected to adjust the loop circumference.

18. The buffered loop antenna according to claim 17 wherein said first and second conductors are sheet metal.

19. The buffered loop antenna according to claim 18 wherein said sheet metal is selected from a group consisting of copper, beryllium copper, and nickel silver.

20. A wristband loop antenna for a wrist worn electronic device, the device including a receiver having signal and ground inputs coupled to an antenna resonating capacitor for resonating the loop antenna to a predetermined frequency, said wristband loop antenna comprising:

a first wristband section, including a first conductor, having a first end for coupling to the receiver signal input and a second end, said first conductor forming a first portion of the loop antenna within said first wristband second, and reactance buffer means, comprising a reactance buffer input coupled to said second end of said first conductor, a plurality of taps linearly disposed along a longitudinal axis of said reactance buffer the distance between the outermost of said plurality of taps providing a predetermined length corresponding to the loop antenna diameter adjustment, and a plurality of reactance elements, arranged non-serially between said reactance buffer input and each of said plurality of taps, wherein one or more of said reactance elements are coupled between said input and a corresponding one of said taps to provide a substantially constant reactance when measured between said reactance buffer input and each of said plurality of taps; and a second wristband section including a second conductor, having a first end coupled to the receiver ground and a second end, said second conductor forming a second portion of the loop antenna within said second wristband section, and coupling means, coupled to said second end of said second conductor, for coupling said second conductor to any of said plurality of taps, whereby when the wristband length is adjusted by selecting any of said plurality of taps, the resonant frequency of said loop antenna remains substantially unchanged.

21. The wristband antenna according to claim 20 wherein said first wristband section further includes compliant top and bottom members for enclosing said first conductor and said reactance buffer means, and said second wristband section further includes compliant top and bottom members for enclosing said second conductor.

22. The wristband antenna according to claim 21 wherein said top and bottom members are molded from a urethane rubber.

23. The wristband antenna according to claim 21 wherein said top and bottom members are die cut from leather.

24. The wristband antenna according to claim 20 wherein said first and second wristband sections further include attachment means for attaching said wristband sections to the electronic device.

25. The wristband antenna according to claim 20 wherein said first and second conductors are sheet metal.

26. The wristband antenna according to claim 25 wherein said sheet metal is selected from a group consisting of copper, beryllium copper, and nickel silver.

27. A wrist worn receiving device, comprising:

a receiver located within a housing; and a wrist band, including first and second wrist band sections coupled to said housing, for securing the housing to a users wrist, said first wristband section forming a first portion of a loop antenna, and including a reactance buffer having an input coupled to said receiver, and a plurality of outputs linearly disposed along a longitudinal axis of said first wristband section opposite said housing, said reactance buffer comprising a plurality of reactance elements, arranged non-serially between said reactance buffer input and each of said plurality of outputs, wherein one or more of said reactance elements are coupled between said input and a corresponding one of said outputs for providing a substantially constant reactance measured between said reactance buffer input and each of said reactance buffer outputs, said second wristband section forming a second portion of the loop antenna, and including a coupling means, coupled to said receiver and affixed to said second wristband section opposite said housing, said coupling means providing selective coupling to said plurality of reactance buffer outputs when securing the housing to the users wrist, whereby the length of said wristband is freely adjustable to fit the users wrist by coupling said coupling means to a corresponding one of said plurality of reactance buffer outputs, and whereby the resonant frequency of said loop antenna remains substantially unchanged when said coupling means is coupled to any of said plurality of outputs.

28. The wrist worn receiving device according to claim 27, wherein each of said reactance elements are formed from a conductor.

29. The wrist worn receiving device according to claim 28, wherein said conductors are formed from sheet metal.

30. The wrist worn receiving device according to claim 29, wherein said sheet metal is selected from a group of sheet metals consisting of copper, beryllium copper, and nickel silver.

31. The wrist worn receiving device according to claim 27 wherein said first and second wrist band sections further include attachment means for coupling said first and second wrist band sections to said housing.

32. The wrist worn receiving device according to claim 27 wherein said first wrist band section further includes a first conductor coupled between said reactance buffer input and said receiver to form the first portion of the loop antenna, and further wherein said second wrist band section further includes a second conductor coupled between said coupling means and said receiver to form the second portion of the loop antenna.

33. The wrist worn receiving device according to claim 32 wherein said first and second conductors are sheet metal.

34. The wrist worn receiving device according to claim 33 wherein said sheet metal is selected from a group consisting of copper, beryllium copper, and nickel silver.

35. The wrist worn receiving device according to claim 27 wherein said first and second wrist band sections are molded from a urethane rubber.

36. The wrist worn receiving device according to claim 27 wherein said first and second wrist band sections are die cut from leather.

37. The wrist worn receiving device according to claim 27 wherein said coupling means is a conductive clasp for providing adjustment of the wrist band length and electrical coupling of the first and second antenna portions.

* * * * *

UNITED STATES PATENT AND TRADEMARK OFFICE

CERTIFICATE OF CORRECTION

PATENT NO. : 5,128,686

DATED : July 7, 1992

INVENTOR(S) : Tan et al.

It is certified that error appears in the above-identified patent and that said Letters Patent is hereby corrected as shown below:

Column 11, line 24, delete "if" and insert --is--.

Signed and Sealed this

Twentieth Day of July, 1993

*Attest:*

Michael K. Kirk

MICHAEL K. KIRK

*Attesting Officer*

*Acting Commissioner of Patents and Trademarks*